US007001047B2

(12) United States Patent
Holder et al.

(10) Patent No.: US 7,001,047 B2
(45) Date of Patent: Feb. 21, 2006

(54) LED LIGHT SOURCE MODULE FOR FLASHLIGHTS

(75) Inventors: Ronald Garrison Holder, Laguna Niguel, CA (US); Greg Rhoads, Irvine, CA (US)

(73) Assignee: Illumination Management Solutions, Inc., Irvine, CA (US)

( * ) Notice: Subject to any disclaimer, the term of this patent is extended or adjusted under 35 U.S.C. 154(b) by 0 days.

(21) Appl. No.: 10/866,357

(22) Filed: Jun. 10, 2004

(65) Prior Publication Data

US 2005/0007768 A1 Jan. 13, 2005

Related U.S. Application Data

(60) Provisional application No. 60/477,319, filed on Jun. 10, 2003.

(51) Int. Cl.
*F21V 7/20* (2006.01)

(52) U.S. Cl. ..... 362/296; 362/294; 362/310; 362/800

(58) Field of Classification Search ..... 362/294, 362/305, 157, 187, 188, 190, 202, 203, 205, 362/208, 218, 257, 277, 285, 295, 288, 296, 362/297, 304, 306, 362, 373, 800, 310
See application file for complete search history.

(56) References Cited

U.S. PATENT DOCUMENTS 4,211,955 A * 7/1980 Ray ..... 315/53
4,286,311 A * 8/1981 Maglica ..... 362/187
4,398,238 A * 8/1983 Nelson ..... 362/187
4,570,208 A * 2/1986 Sassmannshausen ..... 362/188
4,577,263 A * 3/1986 Maglica ..... 362/187
4,727,289 A * 2/1988 Uchida ..... 315/71
4,729,076 A * 3/1988 Masami et al. ..... 362/294
4,733,337 A * 3/1988 Bieberstein ..... 362/202
5,528,474 A * 6/1996 Roney et al. ..... 362/294
5,634,711 A * 6/1997 Kennedy et al. ..... 362/294
5,857,767 A * 1/1999 Hochstein ..... 362/294
5,924,785 A * 7/1999 Zhang et al. ..... 362/241
6,045,240 A * 4/2000 Hochstein ..... 362/294
6,168,288 B1 * 1/2001 St. Claire ..... 362/208
6,371,636 B1 * 4/2002 Wesson ..... 362/545
6,485,160 B1 * 11/2002 Sommers et al. ..... 362/184
6,502,952 B1 * 1/2003 Hartley ..... 362/184
6,685,336 B1 2/2004 Neiser ..... 362/188
6,796,698 B1 * 9/2004 Sommers et al. ..... 352/555

* cited by examiner

*Primary Examiner*—Thomas M. Sember
*Assistant Examiner*—Ismael Negron
(74) *Attorney, Agent, or Firm*—Daniel L. Dawes; Myers Dawes Andras & Sherman LLP

(57) ABSTRACT

A module, or collection of discreet components, for an LED flashlight is coupled to a conventional flashlight body which includes a conventional power source. The module comprise a housing adapted to be coupled to the flashlight body; an LED light source coupled to the power source; a heat sink coupled to the housing, which heat sink is thermally and mechanically coupled to the LED light source; and a reflector coupled to the housing and having an optical axis. The LED light source is positioned by the heat sink on or near the optical axis and is optically coupled to the reflector. The reflector reflects light from the LED light source in a forward direction. The module, and/or components, is arranged and configured to be operatively coupled as a unit to the flashlight body and power source.

23 Claims, 3 Drawing Sheets

LED LIGHT SOURCE MODULE FOR FLASHLIGHTS

RELATED APPLICATIONS

The present application is related to U.S. Provisional Patent Application, Ser. No. 60/477,319, filed on Jun. 10, 2003, which is incorporated herein by reference and to which priority is claimed pursuant to 35 USC 119.

BACKGROUND OF THE INVENTION

1. Field of the Invention

The invention relates to the field of portable handheld lighting devices and in particular to LED flashlights.

2. Description of the Prior Art

The minimum requirements for a common flashlight are: an energy source, typically a battery or batteries, a light source, usually an incandescent lamp, or more recently an LED or an array of LEDs, a means of switching the energy on and off, and a case or housing. LED flashlights are advantageous in that they typically have longer lamp and battery lives, due in large part to their lower power consumption and lower operating temperatures as compared to incandescent units. The better designed LED flashlights have the same or a greater illumination intensity than comparable incandescent units operating at the same or higher power.

However, LED flashlights have typically demonstrated lower beam intensity than conventional incandescent flashlights. Typical LED flashlight implementations generate a broad, unfocused beam, or a small center spot of higher intensity with a broad splash of lower intensity light surrounding the center spot. The illumination factors of intensity, beam shape and beam distribution are mostly controlled by the configuration of the components, not by the designer.

What is needed is a design that focuses or concentrates the broad energy pattern of the LED into a beam, whose shape and intensity is fully controlled at the time of design by the choice of surface contours of its reflector and are not limited by the configuration.

BRIEF SUMMARY OF THE INVENTION

The invention is a module, or an arrangement of components, for an LED flashlight having a flashlight body including a power source comprising: a housing adapted to be coupled to the flashlight body; an LED light source coupled to the power source; a heat sink coupled to the housing, which heat sink is thermally and mechanically coupled to the LED light source; and a reflector coupled to the housing and having an optical axis. The LED light source is positioned by the heat sink on or near the optical axis and is optically coupled to the reflector. The reflector reflects light from the LED light source in a forward direction. The module is arranged and configured to be operatively coupled as a unit to the flashlight body and power source. The reflector surface is shaped to other than a conic profile to provide a reflected beam of a custom distribution pattern of energy from the LED.

The module further comprises a circuit disposed in the housing for providing power from the power source to the LED light source. A circuit board is disposed in the housing on which the circuit is mounted and is coupled to the reflector and/or to the housing.

In the illustrated embodiment, the module is arranged and configured to be operatively coupled as a unit into a conventional flashlight body and power source. The LED light source is positioned by the heat sink forward of the reflector as defined by the forward direction.

The heat sink may provide an electrical coupling from the power source to the LED light source and comprises at least one heat fin for dissipating heat and for positioning the LED light source with respect to the reflector. In the illustrated embodiment the heat sink is thermally coupled to the reflector and/or housing.

In another embodiment the LED light source is axially movable along the optical axis. The heat sink carries the LED light source and is axially movable along the optical axis.

The illustrated embodiment uses an insulated electrical coupling between the LED light source and the power source, which is a flex circuit.

The circuit comprises an LED driver circuit which controls the current to the LED light source and may also prevent over driving the LED light source.

The module or components further comprise a single switch to power on/off the device. In another embodiment, a first switch is provided to power the device on or off and a second switch is located in the tail cap or section of the flashlight that may also control the on/off condition of the flashlight.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 4:
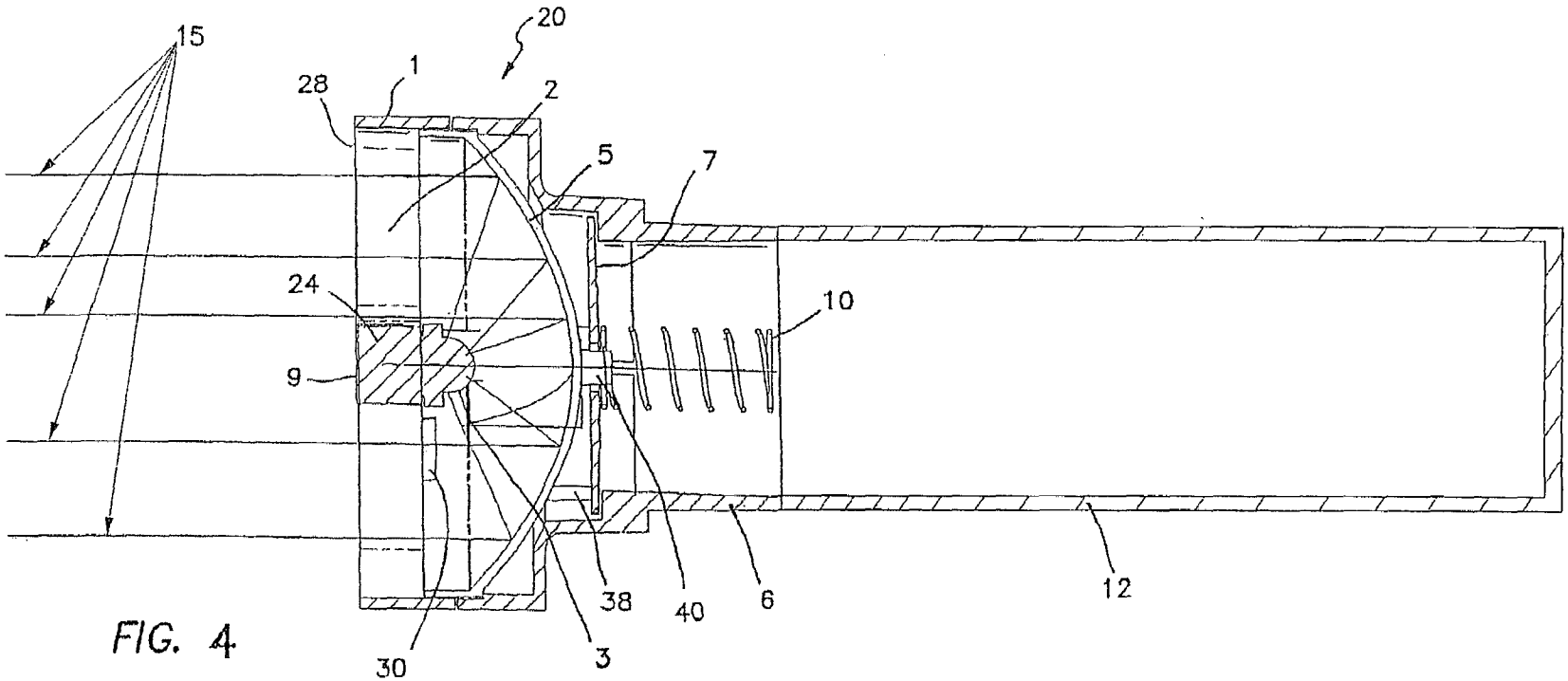
FIG. 4 is a side view of the module and a flashlight body as one of the systems that the module can attach to, according to a preferred embodiment of the present invention.

The invention pertains to the use of light emitting diodes (LED) in a flashlight, which will typically include a flashlight body 12 (shown in FIG. 4), a power source, controls or switches and an illumination module 20, or components disposed and arranged in the flashlight body 12 similarly to their respective positions in the shown module. In the following disclosure for the sake of simplicity, only the illumination module 20, or its equivalent discreet components, will be described, but it must be understood that the scope of the invention includes all the elements of a conventional flashlight, including but not limited to a flashlight body 12, a power source, controls or switches, which will not be further described. The invention provides for the efficient collection and distribution of light emanating from an LED 3 or an array of LEDs 3. The invention further includes thermal management and may include electronic control of the LED(S) 3.

A preferred embodiment of the invention comprises an illumination module 20 that incorporates the LEDs 3, an LED driver circuit, the heat sink 2, means to transfer the current from the circuit to the LED 3 across the heat sink 2, a housing 6 to align the various components in a preferential optical alignment and a means of transferring the energy from the flashlight batteries and switch into the LED driver circuit (not shown) which is mounted on circuit board 7. The preferred embodiment is arranged and configured to allow the module 20 to be retrofitted or inserted into conventional flashlight bodies already manufactured, thereby replacing a conventional incandescent lamp and reflector, as well as being used as a module 20 for a newly manufactured flashlight, or similarly arranged components.

Figure 1:
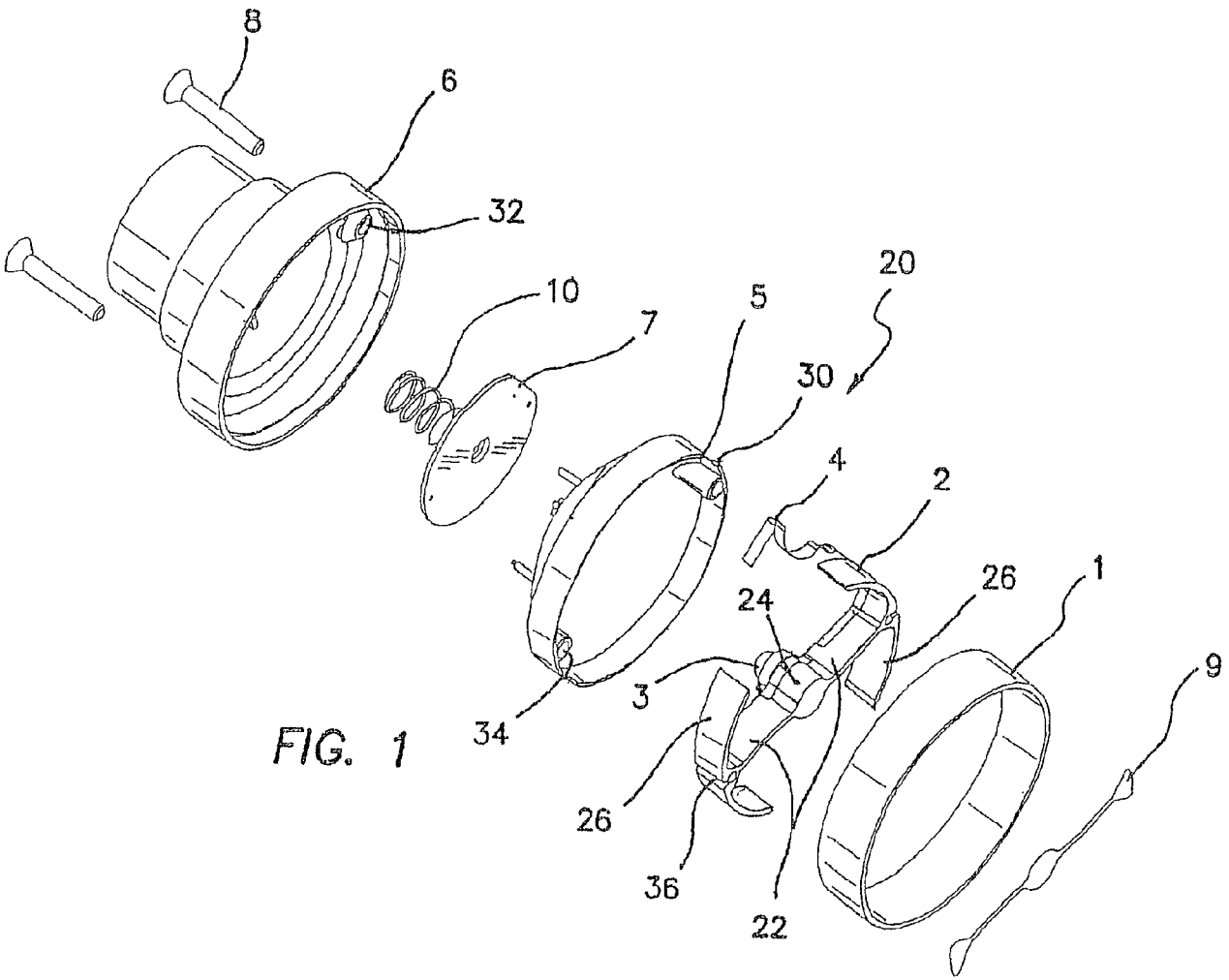
FIG. 1 is an exploded perspective view of an LED flashlight module of the invention.
Figure 2:
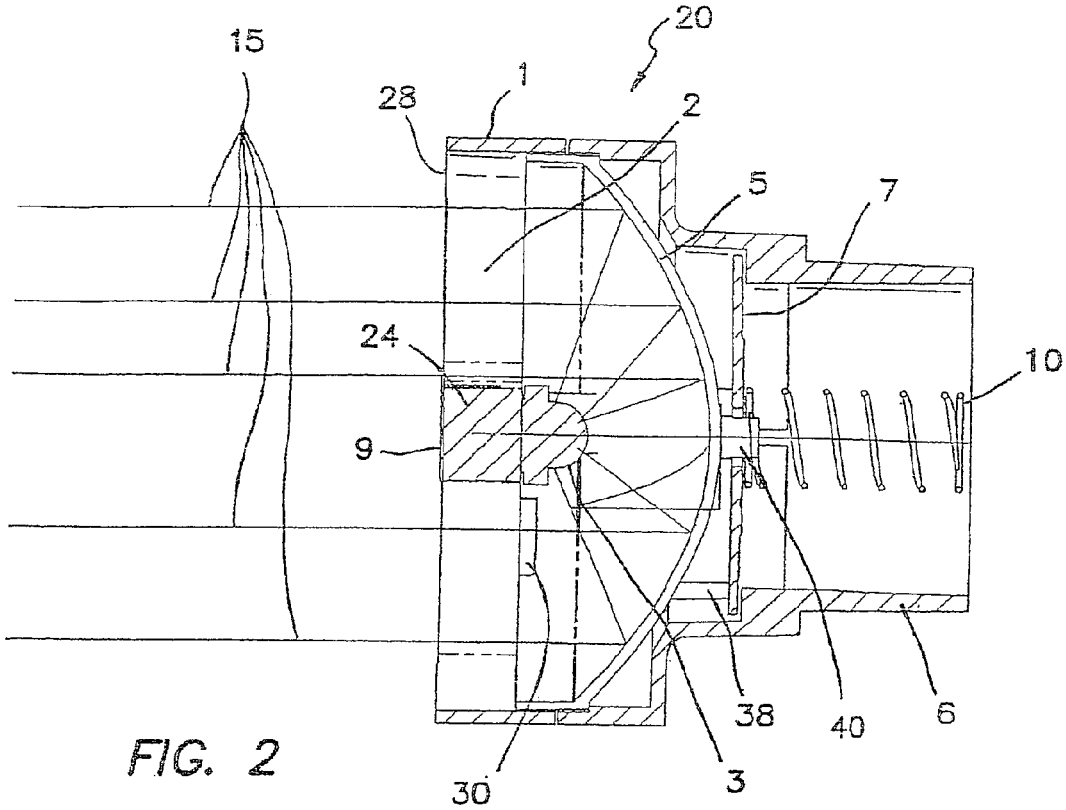
FIG. 2 is a side cross-sectional view of the module of FIG. 1 taken through section lines 2—2 of FIG. 3.

The invention shown in FIGS. 1 and 2 is a highly efficient LED flashlight with an energy source, at least one LED 3, a reflector 5, a heat sink 2 to mount the LED(s) 3 over the reflector 5, a driver circuit (not shown) for converting the energy in the battery to the voltage and current desired to operate the LED(s) 3 and at least one switching mechanism or control (not shown) coupled to the circuit. The driver circuit and switching mechanism or control are conventional and will not be further specified, but include all known driver circuits, switching mechanisms or controls now known or later devised. The particularities of the driver circuits, switching mechanisms or controls are not material to the invention and many well known driver circuits, switching mechanisms or controls used with LEDs can be equivalently employed.

The LED 3 is mounted to a heat sink 2 which is made of a heat conductive material that provides the thermal management or temperature control for the LED 3. This heat sink 2 also positions the LED 3 over the reflector 5 with the primary light direction of the LED 3 facing into the reflector 5 as shown in the exploded perspective view of FIG. 1 and the assembled side cross-sectional view of FIG. 2. The reflector 5 then reflects the light back out the front of illumination module 20 in the forward direction of the flashlight. The illustrated embodiment shows LED 3 turned around and pointing back into reflector 5 in a direction reverse to the forward direction of propagation of the beam from module 20. The reflector 5 performs two very important optical tasks. The first task is to surround the LED and collect virtually all of the energy radiated from it. The second function is to reflect the energy so collected into a beam of the designer's intent. In its simplest form reflector 5 would be parabolic in shape to reflect all the energy into a narrow, high intensity beam. It is, however, the intent of the invention to allow freedom in the beam design by allowing the reflector's surface shape to be manipulated to create a beam of virtually any profile, thus incorporating nearly all the energy of the LED 3 into a preferred or custom-shaped beam. Since nearly 100 percent of the LED 3 energy is 'captured' by the reflector 5, a tailored beam will be nearly as efficient as is possible.

The invention shown in FIGS. 1 and 2 is a highly efficient LED flashlight with an energy source, at least one LED 3, a reflector 5, a heat sink 2 to mount the LED(s) 3 over the reflector 5, a driver circuit (not shown) for converting the energy in the battery to the voltage and current desired to operate the LED(s) 3 and at least one switching mechanism or control (not shown) coupled to the circuit. The driver circuit and switching mechanism or control are conventional and will not be further specified, but include all known driver circuits, switching mechanisms or controls now known or later devised. The particularities of the driver circuits, switching mechanisms or controls are not material to the main ideas of the invention and many well known driver circuits, switching mechanisms or controls used with LEDs can be equivalently employed.

The optional circuit board 7 which also carries the power and control circuitry (not shown) needed to operate LED 3 and provides current to the LED 3 receives current from the power source (not shown) via contacts either on the circuit board 7 or in the illustrated embodiment through a spring contact 10 which is soldered to circuit board 7 or which compressively bears against a circuit board 7. Circuit board 7 is fixed to a plurality of standoffs 38 defined in housing 6, one of which is shown in the view of FIG. 2 or may be simply connected to an axial post 40 extending from the rear surface of reflector 5. Electrical connection to LED 3 from the power source and controls or switches is also provided through heat sink 2, which is electrically conductive as is housing 6. Typically, heat sink 2 and housing 6 will be coupled in a conventional manner through the body 12 of the flashlight or by a separate electrical connection to the ground of the power source. The current or power to operate the LED 3 is delivered via insulated wires or in the embodiment shown in FIGS. 1 and 2 by a flat flex circuit 4. Flex circuit 4 is led through a cutout 30 defined in reflector 5 and electrically coupled to the power and control circuitry on circuit board 7 behind reflector 5. Flex circuit 4 may include at least two insulated wires and provide both the power lead to LED 3 and its ground return. Alternatively, ground return can be provided by means of insulated wires or in the illustrated embodiment through the conductive bodies of heat sink 2 and housing 6. The lamp circuit, either as an integrated circuit or as discretely situated electrical components, are designed to provide a predetermined current to the LED 3, which current is may be proportional to the input current or may provide a steady current to LED 3 regardless of input current from the power source. Alternatively the current to LED 3 may be user determined or electronically determined by a combination of controls. The driver circuit will at a minimum control the current to the LEDs 3 and may prevent over driving of the LEDs 3.

Figure 3:
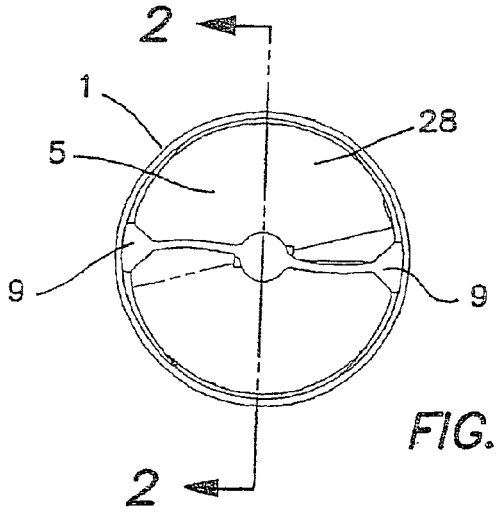
FIG. 3 is a front plan view of the end of the module through which the light is transmitted.

A label 9, adhered to face plate 28, as best seen in the front plan view of FIG. 3, is optionally utilized to hide the fasteners 8 which are led through bore holes 32 defined in housing 6, bore holes 34 defined in reflector 5 and which screw into threaded receiving bores 36 defined in heat sink 2. Fasteners 8 bind the components of module 20 together while allowing disassembly for servicing if needed. Label 9 also provides an exterior surface for graphic identification.

The LED 3 is positioned facing into reflector 5. The housing 6 is used in the illustrated embodiment to provide a means for alignment of reflector 5 and the combination of the heat sink 2/LED 3 assembly. In alternative embodiments the housing 6 could be the flashlight body 12 itself, rather than a separate module. However, in the illustrated embodiment the components of the module 20 are formed into one assembly that is used as a unitary lamp unit to plug or screw into a conventional flashlight, replacing the conventional reflector, incandescent lamp and associated portion of the flashlight illumination head. Thus, it is to be understood that housing 6 is provided with threading on its rear portions or whatever other coupling structure is needed to readily be connected to a conventional incandescent flashlight body 12 in the conventional manner. In this way an existing conventional incandescent flashlight can be converted into a long-life, bright LED flashlight by the user and pre-existing flashlight bodies and power packs converted by manufacturers into LED flashlights without any design or manufacturing modifications.

The reflector 5 may be designed to provide a collimated beam 15, a convergent beam, or a divergent beam as may be desired. The reflector 5 may be a common conic section or some other shaped surface. The reflecting surface of reflector 5 may be coated, faceted, dimpled, or otherwise modified to provide a desired beam pattern or quality. The invention provides that reflector 5 surrounds the LED 3 and collects nearly all its energy onto its surface(s). Further the invention describes the surface(s) of the reflector 5 are capable of reflecting the energy into almost any desirable beam shape. The energy collected onto its surface(s) may be designed to provide a collimated beam, a beam with uniform distribution, a beam with non-uniform distribution or a beam of almost any description. This capability is one of the more important aspects of the invention.

Many alterations and modifications may be made by those having ordinary skill in the art without departing from the spirit and scope of the invention. For example, the coupling between collar 1 and heat sink 2 with housing 6 may be modified so that fasteners 8 couple housing 6 and reflector 5 together, but leave collar 1 and heat sink 2 free to be rotated and longitudinally moved in or out on a male/female screw coupling between collar 1 and housing 6. In this way, LED 3 may be longitudinally displaced on the optical axis of reflector 5 to allow for beam focusing or shaping, commonly termed "zoom control", as is well known to the art, depending on the reflector properties.

Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. A module for an LED flashlight having a flashlight body including a power source, the module comprising:

a housing adapted to be coupled to the flashlight body;

an LED light source adapted to be coupled to the power source, and having a peak emission direction, a heat sink coupled to the housing, the LED light source is thermally and mechanically coupled to the heat sink, a single reflector coupled to the housing and having an optical axis, the LED light source being positioned by the heat sink about the optical axis and directly optically coupled to the single reflector with the peak emission direction pointing into the reflector in a direction reverse to a forward light output direction of the module, the single reflector collecting virtually all of the light produced from the LED light source and reflecting such light in the forward direction; and wherein the module is arranged and configured to be operatively coupled as a unit to the flashlight body and power source.

2. The module of claim 1 wherein the module is arranged and configured to be operatively coupled as a unit into a conventional incandescent flashlight body and power source.

3. The module of claim 1 wherein the LED light source is positioned by the heat sink forward of the reflector as defined by the forward direction.

4. The module of claim 1 where the heat sink provides an electrical coupling from the power source to the LED light source.

5. The module of claim 1 where the heat sink comprises at least one heat fin for dissipating heat and for positioning the LED light source with respect to the reflector.

6. The module of claim 1 where the heat sink is thermally coupled to the reflector.

7. The module of claim 1 further comprising an insulated electrical coupling between the LED light source and the power source.

8. The module or components of claim 1 where the reflector surface is shaped to other than a conic profile to provide a reflected beam of a custom distribution pattern of energy from the LED.

9. The module of claim 1 where the heat sink is thermally coupled to the housing.

10. The module of claim 1 further comprising an LED power circuit disposed in the housing for providing power from the power source suitable for powering the LED light source.

11. The module of claim 10 where the LED power circuit comprises an LED driver circuit which controls the current to the LED light source to prevent over driving the LED light source.

12. The module of claim 10 further comprising a circuit board disposed in the housing on which the LED power circuit is mounted.

13. The module of claim 12 where the circuit board is coupled to the reflector.

14. The module of claim 3 where the circuit board is coupled to the housing.

15. A module for an LED light source Coupled to a power source, comprising:

a housing;

an LED light source coupled to the power source;

a heat sink coupled to the housing, the LED light source thermally and mechanically coupled to the heat sink;

a single reflector coupled to the housing and having an optical axis, the LED light source being positioned by the heat sink about the optical axis and being optically coupled to the single reflector, the LED light source being positioned with respect to the single reflector to radiate substantially all of the light generated by the LED light source directly toward the single reflector, which single reflector then reflects the light into the forward light output direction of the module after a single reflection, the single reflector reflecting nearly all of the light from the LED light source in the forward light output direction;

an LED power circuit disposed in the body for providing power from the power source to the LED light source;

a circuit board disposed in the housing on which the LED power circuit is mounted;

wherein nearly 100% of the LED light is captured and distributed by the single reflector.

16. The module of claim 15 further comprising a light fixture with which the module is combined.

17. The module of claim 15 further comprising a head torch with which the module is combined.

18. An integrated system of components for an LED flashlight having a flashlight body including a conventional power source, comprising:

an LED light source coupled to the power source;

a heat sink coupled to the housing, the LED light source thermally and mechanically coupled to the heat sink, the heat sink having at least one heat fin for dissipating heat;

a single reflector having an optical axis, the LED light source being positioned by the heat sink about the optical axis and being optically coupled to the single reflector, the single reflector reflecting light from the LED light source in a forward light output direction of the module, the heat fin of the heat sink positioning the LED light source forward of the single reflector as defined by the forward light output direction, the LED light source being positioned with respect to the single reflector to radiate substantially all of the light generated by the LED light source directly toward the single reflector, which single reflector then reflects the light into the forward light output direction after a single reflection;

an LED power circuit disposed in the body for providing power from the power source to the LED light source;

a circuit board disposed in the housing on which the LED power circuit is mounted; and wherein the components are arranged and configured to be operatively coupled as a unit to the flashlight body and power source.

19. The module or components of claim 18 further comprising a single switch to power on/off the device.

20. A module for an LED flashlight having a flashlight body including a power source, the module comprising:

a housing adapted to be coupled to the flashlight body;

an LED light source adapted to be coupled to the power source;

a heat sink coupled to the housing the LED light source being thermally and mechanically coupled to the heat sink; and a single reflector coupled to the housing and having an optical axis, the LED light source being positioned by the heat sink about the optical axis and being directly optically coupled to the reflector, the reflector reflecting light from the LED light source in a forward light output direction of the module;

wherein an insulated electrical coupling is located between the LED light source and the power source, and comprises a flex circuit.

21. An integrated module for an LED flashlight having a conventional incandescent flashlight body including a conventional power source comprising:

a housing adapted to be coupled to the conventional incandescent flashlight body;

an LED light source adapted to be coupled to the power source;

a heat sink coupled to the housing, the LED light source thermally and mechanically coupled to the heat sink, the heat sink having at least one heat fin for dissipating heat;

a single reflector coupled to the housing and having an optical axis, the LED light source being positioned by the heat sink about the optical axis and being directly optically coupled to the single reflector, the single reflector reflecting light from the LED light source in a forward light output direction of the module, the heat fin of the heat sink positioning the LED light source forward of the single reflector as defined by the forward light output direction, the LED light source being positioned with respect to the single reflector to radiate substantially all of the light generated by the LED light source directly toward the single reflector, which single reflector then reflects the light into the forward light output direction after a single reflection;

an LED power circuit disposed in the housing for providing power from the power source to the LED light source;

a circuit board disposed in the housing on which the LED power circuit is mounted; and wherein the module is arranged and configured to be operatively coupled as a unit to the flashlight body and power source.

22. A modules for an LED flashlight having a flashlight boy including a power source, comprising:

a housing adapted to be coupled to the flashlight body;

an LED light source adapted to be coupled to the power source;

a heat sink coupled to the housing, the LED light source thermally and mechanically coupled to the heat sink; and a single reflector coupled to the housing and having an optical axis, the LED light source being positioned by the heat sink about the optical axis and being optically coupled to the single reflector, the single reflector reflecting light from the LED light source in a forward light output direction of the module, and a first switch to power on/off the flashlight and a second switch located in a tail cap section of the flashlight to also control the on/off condition of the flashlight.

23. A module for an LED light coupled to a power source, comprising:

a housing;

a flex circuit;

an LED light source coupled to the power source through the flex circuit;

a heat sink coupled to the housing, the LED light source thermally and mechanically coupled to the heat sink;

a single reflector coupled to the housing and having an optical axis, the LED light source being positioned by the heat sink about the optical axis and being optically coupled to the single reflector, the LED light source being positioned with respect to the single reflector to radiate substantially all of the light generated by the LED light source directly toward the single reflector, which single reflector then reflects the light into a forward light output direction after a single reflection, the single reflector reflecting nearly all of the light from the LED light source in a forward light output direction of the module;

an LED power circuit disposed in the body for providing power from the power source to the LED light source;

a circuit board disposed in the housing on which the LED power circuit is mounted;

wherein nearly 100% of the LED light is captured and distributed by the single reflector.

* * * * *